United States Patent [19]

Gauselmann

[11] Patent Number: 4,722,527

[45] Date of Patent: Feb. 2, 1988

[54] COIN-OPERATED GAMES MACHINE WITH A DISPLAY APPARATUS

[76] Inventor: Paul Gauselmann, c/o ADP-Automaten, Boschstrasse 8, 4990 Lubbecke, Fed. Rep. of Germany

[21] Appl. No.: 816,798

[22] Filed: Jan. 7, 1986

[30] Foreign Application Priority Data

Jan. 14, 1985 [DE] Fed. Rep. of Germany ..... 3500946

[51] Int. Cl.[4] ..... A63F 5/04

[52] U.S. Cl. ..... 273/143 R; 40/475

[58] Field of Search ..... 273/143 R, 138 A, 139; 40/475, 500

[56] References Cited

U.S. PATENT DOCUMENTS

| | | | |
|---|---|---|---|
| 200,460 | 2/1878 | Koch | 40/475 |
| 1,718,898 | 6/1929 | Fagan | 273/143 R |
| 1,746,581 | 2/1930 | Dolar | 40/475 |
| 3,192,656 | 7/1965 | Christensen | 40/475 X |
| 3,771,242 | 11/1973 | Lagasse et al. | 40/475 |
| 3,910,582 | 10/1975 | Richards | 273/143 R |
| 4,198,052 | 4/1980 | Gauselmann | 273/143 R |
| 4,273,334 | 6/1981 | Schone et al. | 273/143 R |
| 4,342,992 | 8/1982 | Bozzini | 40/475 X |

FOREIGN PATENT DOCUMENTS

| | | | |
|---|---|---|---|
| 728866 | 3/1966 | Canada | 40/500 |
| 86298 | 8/1983 | European Pat. Off. | 273/143 R |
| 1202688 | 10/1965 | Fed. Rep. of Germany . | |
| 3229673 | 2/1984 | Fed. Rep. of Germany . | |
| 645854 | 9/1962 | Italy | 40/475 |
| 939069 | 10/1963 | United Kingdom | 40/475 |
| 1550732 | 8/1979 | United Kingdom | 273/143 R |
| 2117546 | 10/1983 | United Kingdom | 273/143 R |

*Primary Examiner*—Paul E. Shapiro

*Attorney, Agent, or Firm*—Oblon, Fisher, Spivak, McClelland, & Maier

[57] ABSTRACT

A rotary flap display system has a large number of indicia bearing flaps mounted on a motor driven hub within a housing. The housing has a lug along the upper edge of an opening through which the flaps may be seen for restraining the flap to flip forward one at a time. The lug includes a hole through which a jet of air emerges to assist flipping of each flap as it passes the lug.

17 Claims, 5 Drawing Figures

COIN-OPERATED GAMES MACHINE WITH A DISPLAY APPARATUS

Figure 2:
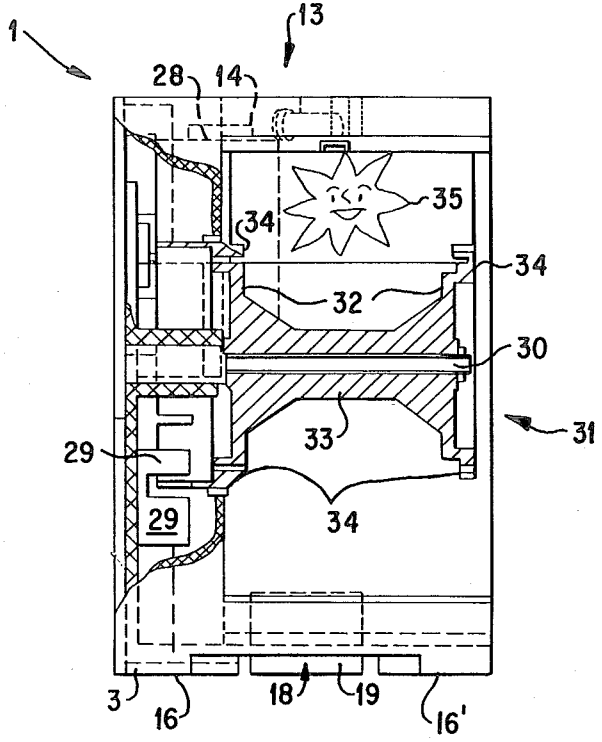

Coin-operated games machine with at least one display apparatus in which an electro-mechanical drive member moves symbol carriers behind a window into which the player can look in a cyclic repetition in order to display, when the machine is stopped by random control, at least one symbol as a partial result of the game which may together with other symbols constitute the result of a game.

Coin-operated games machines of the kind described above are known with symbol display devices of all kinds, usually using rotating rollers or discs. Since only limited space is available for the incorporation of the display apparatus, only a limited number of symbols can be represented on the periphery or front of the revolving members. From German Offenlegungschrift No. 27 32 884, a display apparatus with rod elements which can be moved up and down is known, but this also has the same disadvantages as the rotary types. Moreover, from German Offenlegungschrift No. 31 00 650 a display apparatus is known in which the symbols are printed on flexible rotating strips. The disadvantage of this display apparatus is that the strips rapidly wear out.

The aim of this invention is to provide a coin-operated games machine of the type described above, the display apparatus of which is able to display a large number of symbols whilst having only a small constructional volume.

This aim is achieved by the fact that the display apparatus has a revolving arrangement of flap panels known per se, the flap panels being the symbol carriers which are pivotally mounted on a hub which can be rotated by the drive member in only one direction, so as to flip over from a front to a reverse display position on passing a lug, and an assembly block is provided for receiving all the components of the display apparatus. In view of the large number of flap panels on the revolving arrangement (hereinafter referred to as a carousel), only a small angle of rotation is required in order to display a different symbol. Thus, even when the carousel of flap panels is moving at a low speed, a sufficiently high symbol frequency is achieved for the coin-operated games machine, with the result that low-powered drive members can be used. It should be noted that the moment of mass inertia of the symbol-carrying carousel, which is much reduced compared with the known display apparatus, further reduces the drive power required. A major advantage of the display apparatus according to the invention is the fact that the facing surfaces of two adjacent flap panels on the periphery may be used to represent both a symbol extending over both symbol carriers and also a number of symbols which would be highly legible, thereby providing a differentiated display of symbols for determining the prize.

Other advantageous features of the coin-operated games machine according to the invention will be found in the sub-claims.

Figure 1:
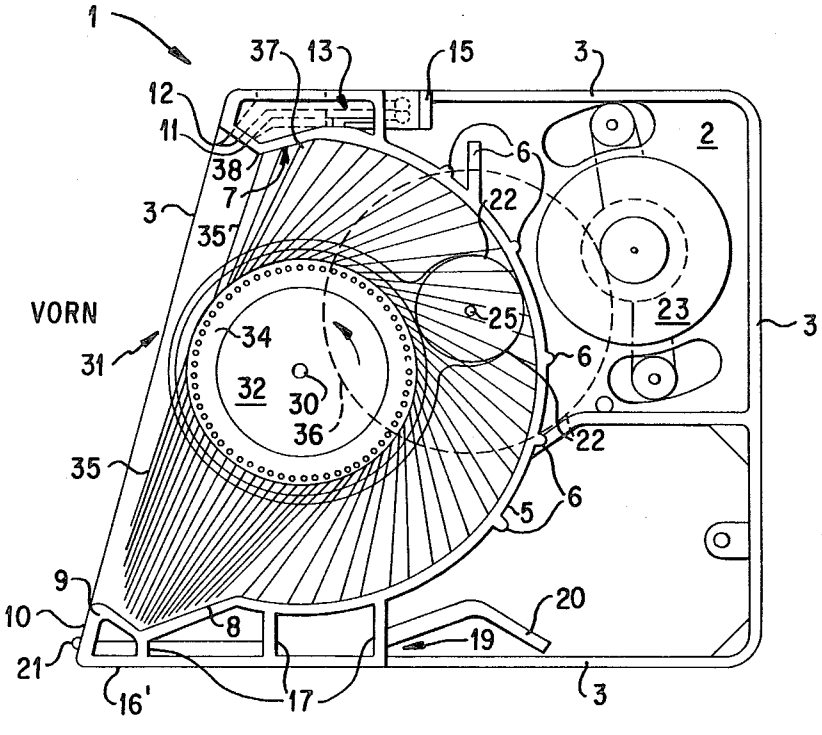
Figure 3:
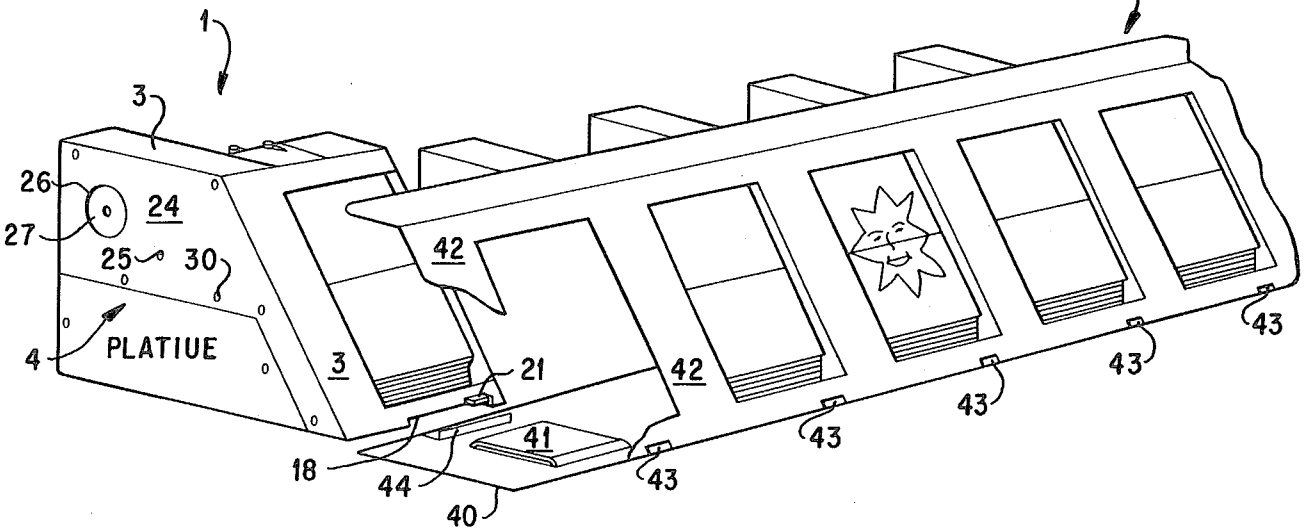
Figure 4:
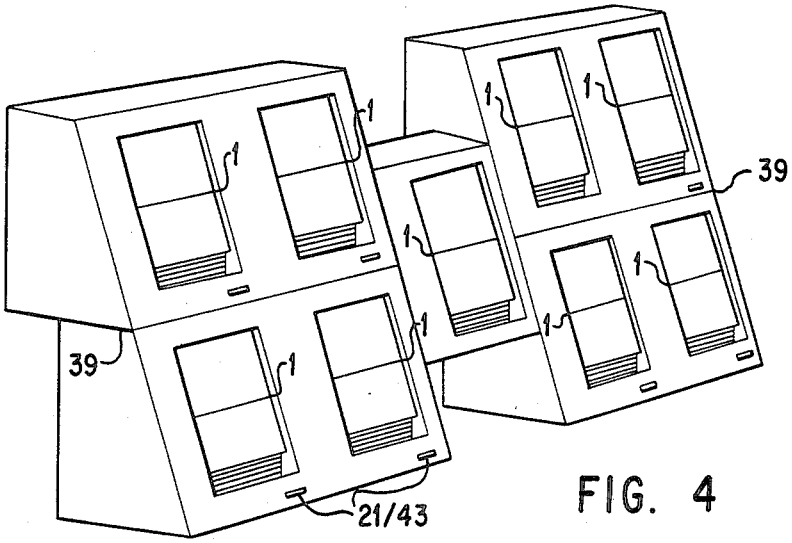
Figure 5:
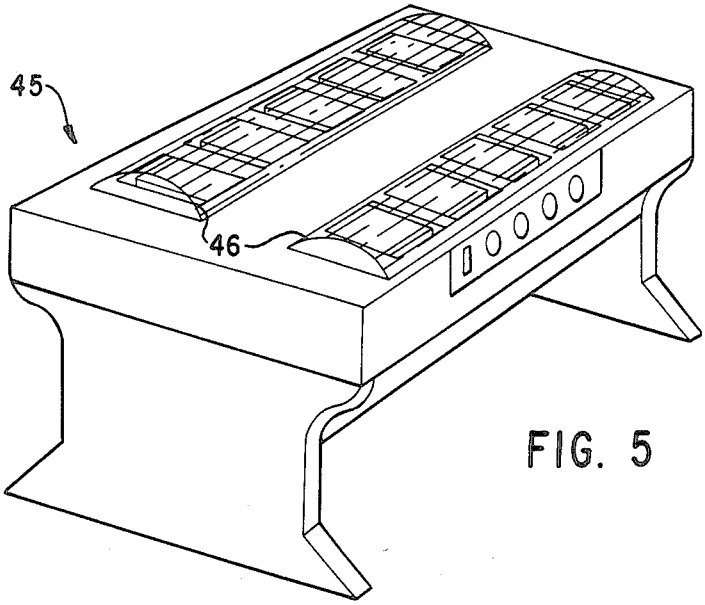

The invention is hereinafter described more fully with reference to an embodiment by way of an example shown in the accompanying drawing, wherein:

FIG. 1 is a side view of a display apparatus according to the invention,

FIG. 2 is a front view of the display apparatus according to FIG. 1, shown in section, FIG. 3 is a perspective view of a first receiving frame for receiving a plurality of display apparatus according to FIG. 1, FIG. 4 is a perspective view of a second receiving frame for receiving a plurality of display apparatus according to FIG. 1 and FIG. 5 is a table-top games machine with a horizontal display position for the display apparatus as shown in FIGS. 1 and 3.

For the display apparatus shown in FIGS. 1 and 2 and generally designated 1, an assembly block 2 is produced from plastics as an integral injection-moulded component; it is also shown in perspective view on the left in FIG. 3. The assembly block 2, together with its individual components and the parts which it carries, does not essentially deviate from a block-shape which is diagonally cut off at the front, so that a plurality of display apparatus 1 can be arranged side by side without a gap.

The assembly block 2 is formed with a strip 3 running around its left-hand side and bounding five surfaces of the cut-away block. In the surface enclosed by the strip 3 (FIG. 1) there are partly perforated walls provided in different planes extending parallel to the left-hand side 4 of the block, these walls serving for the attachment of components, mechanical reinforcement and means for protecting from dust and light. The walls are divided by bars positioned vertically on them to form a compartmental arrangement.

The assembly block 2 is formed as a magazine wall 5 on its right-hand side, which stands out vertically from the walls, the circular cross-sectional shape being shown in FIG. 1. Raised corrugations 6 formed on the back strengthen the magazine wall 5 which merges into a lug 7 at the front, at one end (at the top in FIG. 1), and ends at its other (lower) end, via a ramp 8, in a reinforcing step 9, the front edge 10 of which, together with the lug edge 11 and the strip 3, is located in a plane, the front plane (FIGS. 1–3). The lug 7, ramp 8 and reinforcing step 9 are constructed as hollow components so as to save on material and reduce the weight.

The lug 7 is provided with a hole 12 and behind the front edge 10, in the centre, there is a parallelipipedinal space 13 for receiving an intermediate member 14 (to be described hereinafter) which is releasably connected to the assembly block 2 by means of a spring-catch 15.

The strip 3 encircling the block on the left-hand side is formed as a runner 16 underneath. It should be pointed out that the terms "underneath" and "on top" refer only to the view shown in the drawings and not to the actual position of the assembly block 2 or display apparatus 1 when in use. A second runner 16′ of the same width as the first extends to the right below the reinforcing step 9, the ramp 8 and the magazine wall 5. It extends parallel to the first and is connected by means of bars 17 to the above-mentioned components 9, 8 and 5 and to the front edge 10. Thus, between the runners 16 and 16′ a guide groove 18 is formed which widens out in a funnel shape at the front. In the guide groove 18 a spring pawl 19 which ends in an actuating lever 20 extends backwards.

Standing out of the front edge 10 of the reinforcing step 9 is a small positioning wedge 21 which is arranged above the guide groove 18 in the region of the funnel-shaped widening.

From the left-hand side of the assembly block 2, a stepped gearwheel 22 with two different gear rims and an adjusting bearing disk 23 are placed in the compartments mentioned above and a mounting plate 24 is put on, a first mounting spindle 25 passing through the gear wheel 22 and a bearing hole 26 centering the adjusting mounting disk 23 on a guide disk 27. Admittedly the mounting plate 24 covers only part of the surface enclosed by the strip 3, but it projects up to the strip 3 on all four sides so that it is automatically only able to be mounted in the correct position. Screws are used to fix it in place. A control plate is screwed onto the part of the surface surrounded by the strip 3 which is not covered by the bearing plate 24.

From the right-hand side of the assembly block 2, a stepping motor 28 is secured to the adjusting bearing disc 23, the shaft of which carries a pinion which meshes with the larger gear rim of the stepped gear wheel 22. Excitation lines from the stepping motor are conveyed using a quadruple line which ends in a plug. The plug is fitted into a mating connector on the plate which carries a control logic with a driver circuit. The plate carries a further plug board through which operating current and advancing pulses are received and positioning pulses are sent back to a light barrier in the form of a fork coupler 29 also provided on the plate.

A second mounting spindle 30, also fixedly connected to the mounting plate 24, and extending concentrically with the magazine wall 5, serves to receive a carousel 31 of flap panels. The flap panel carousel 31 consists of a hub portion 32 having two identical discs 34 with a ring of perforations, these discs being connected to each other by means of a sleeve 33. Each ring of perforations 34 has 60 holes uniformly distributed over the circumference of the ring 34. Two holes located opposite one another on a line parallel to the rotation axis on the two rings of perforations 34 form a pair of holes which carries a flap panel 35 on bearing pins so that the carousel has 60 flap panels. Adjoining the left-hand disc 34 with its ring of perforations is a circular hollow cylinder which carries a gear rim and, at its rear end, a marking. The flap panel carousel 31 is fitted onto the second mounting spindle 30 from the right, so that on the one hand the latter gear rim meshes with the smaller gear rim of the stepping gear wheel 22 and on the other hand the end of the circular hollow cylinder of the marking penetrates between the forks of the fork coupler 29 in order to control the light current of the light barrier, when the flap panel carousel 31 is moved, in order to form the positioning pulses.

The flap panel carousel 31 of the display apparatus 1 which is arranged behind a window in a coin-operated games machine into which the player can look, is set in rotation at the start of the game and this rotation can only be in the left-hand direction indicated by an arrow 36 in FIG. 1. The outer edges of the flap panels 35 abutting on the magazine wall 5 are pulled along at a constant angular velocity with a constant speed of traction determined by the radius of the magazine wall 5. The flap panels 35 which are pulled along the back 37 of the lug 7 are slowed down in their speed of action by the reduced radius and an accumulation of flap panels 35 occurs, in which they are slightly bent because of their elasticity.

On passing the tip 38 of the lug, the retaining force of the lug 7 is overcome and the flap panel 35 is subjected to a twist which causes it to pivot out of its front display position into its reverse display position.

Owing to the force of gravity, this reverse display position is stable; both an upright operating position as shown in FIGS. 1-4 and also a horizontal operating position as shown in FIG. 5 are possible.

The pivoting over of the flap panels 35, which is comparable to leafing through the pages of a book, is aided by a current of air from the hole in the lug. This aid is required particularly when ventilator cooling is used in coin-operated games machines 1 and to enable a free selection of the operating position; the air current stabilizes the reverse display position. The air comes out of a compressor device through a hose into a spout of the intermediate member 14 which is constructed as a jet in the region of the hole 12.

The pivoted flap panels 35 first of all accumulate once more in front of the ramp 8, where the direction is reversed. At the point of reversal the flap panel 35 stands radially away from the hub portion 32.

The flap panel carousel 31 is stopped by a randomly controlled stoppage of the stepping motor 28 in order to display to the player one or two symbols on two flap panels 35, one in the front display position and the other in the reverse display position, depending on whether the pair of flap panels are printed with half or full symbols. The pair of flap panels displays a partial result of the game which, in conjunction with symbols displayed on other pairs of flap panels, constitutes the result of the entire game.

The stepping motor 28 can be rotated on its adjusting bearing disc 23 about its rotating axis so that the phase position can be adjusted between the advancing pulse and flipping over. The adjusting bearing disc 23 is clamped between the mounting plate 24 and the compartmental wall, so as to give rise to a frictional force which can be adjusted by means of the screws with which the mounting plate 24 is held on the assembly block 2.

It should be pointed out that instead of the stepping motor 28 it is also possible to use a lifting magnet the armature of which acts on a toothed directional locking mechanism.

FIGS. 3 and 4 show several display apparatus 1 arranged side by side and one above the other in different receiving frames 39. FIG. 3 shows a guide bar 41 stamped out from a base wall 40, and resting in the guide groove 18 when the display apparatus 1 is inserted.

A slot 43 is stamped out of the inclined front wall 42 of the receiving frame 39 which is made of sheet-metal, this slot 43 determining the lateral and vertical position of the display apparatus 1 by means of its positioning wedge 21. The base wall 40 also has a holding angle 44 which releasably holds the display apparatus 1 on its spring pawl 19.

FIG. 5 shows a table-top games machine 45 with two play positions one opposite the other, using two of the receiving frames 43 shown in FIG. 3. The windows 46 are convex panes which on the one hand enclose the space necessary for the pivoting of the flat panels 35 and on the other hand ensure a favourable air-flow for the pivoting movement.

I claim:

1. Coin-operated games machine with at least one display apparatus, in which an electromechanical drive member moves symbol carriers behind a window into which a player can see in cyclic repetition in order to display at least one symbol as the result of a part of a game, when the machine stops under random control, and this symbol in conjunction with other symbols may represent the result of the game, wherein the display apparatus comprises a revolving arrangement of flap panels which are the symbol carriers, and which are pivotally mounted on a hub rotatable in only one direction by a drive member in order to flap over from a front display position to a reverse display position on passing a lug, and an assembly block provided for receiving the revolving arrangement of flap panels, the hub, the drive member, and the lug; and said lug including a hole through which a current of air emerging from a jet is directed onto the pivoting flap panel.

2. Coin-operated games machine as claimed in claim 1, wherein the hub comprises two discs provided with a ring of perforations, these discs being fixedly connected to each other by means of a sleeve, and the flap panels comprise bearing pins mounted in a pair of holes, the holes of the two rings of perforations being located opposite each other on a line parallel to the rotation of axis.

3. Coin-operated games machine as claimed in claim 2, further comprising a circular hollow cylinder formed on the hub, which carries a driving toothed rim and, at its end remote from the hub, a marker, and the end of the circular hollow cylinder runs in the fork of a positioning pulse-generating fork coupler.

4. Coin-operated game machine as claimed in claim 2, wherein the hug is an integral injection-moulded component.

5. Coin-operated games machine as claimed in claim 1, comprising a magazine wall which surrounds the flap panels which are not in the displaying position, concentrically with regard to the rotation axis of the revolving arrangement.

6. Coin-operated games machine as claimed in claim 5, wherein the radius of the magazine wall is larger than the radius of the hub and smaller than the sum of the hub radius and the radial length of the edges of the flap panels.

7. Coin-operated games machine as claimed in claim 5, wherein the magazine wall is formed as the lug in an edge area where the flap panel is in its front displaying position and as a ramp in an edge area where the flap panel is in its reverse display position, the ramp reducing its spacing from the hub progressively in the direction of rotation.

8. Coin-operated games machine as claimed in claim 1, wherein the drive member can be advanced stepwise and the number of steps for successive flapping over is a constant whole number.

9. Coin-operated games machine as claimed in the claim 8, comprising an adjusting bearing disc which rotatably mounts the drive member about its rotation axis.

10. Coin-operated games machine as claimed in claim 9, wherein the drive member is a stepping motor.

11. Coin-operated games machine as claimed in claim 9, wherein the drive member is a lifting magnet having an armature which acts on a toothed directional locking mechanism.

12. Coin-operated games machine as claimed in claim 11, wherein the assembly block is an integral injection-moulded component.

13. Coin-operated games machine as claimed in claim 9, wherein the assembly block with all its components and the parts which it carries does not project beyond a block which is cut off diagonally at the front, and wherein a plurality of said display apparatus are arranged adjacent one another.

14. Coin-operated games machine as claimed in claim 13, comprising a plate screwed to the assembly block and forming a side wall, this plate carrying the fork coupler, electronic control components and at least one plug board.

15. Coin-operated games machine as claimed in claim 14, comprising a bearing plate for the drive member and the hub of the revolving arrangement of flap panels, this bearing plate being screwed to the assembly block and forming the side wall.

16. Coin-operated games machine as claimed in claim 15, wherein the plate and the bearing plate together form the side wall.

17. Coin-operated games machine as claimed in claim 15, wherein the assembly block comprises first guide means and a spring catch; and further comprising a receiving frame which has, for each display apparatus which is to be received, second guide means which match the first guide means; and a retaining angle which releasably holds the display apparatus in the receiving frame.

* * * * *